US005857564A

United States Patent [19]

Hymowitz

[11] Patent Number: 5,857,564

[45] Date of Patent: Jan. 12, 1999

[54] COMPACT MATERIAL STORAGE AND DISPENSING UNIT

[76] Inventor: Dennis Hymowitz, 1325 E. 17th St., Brooklyn, N.Y. 11230

[21] Appl. No.: 963,690

[22] Filed: Nov. 4, 1997

Related U.S. Application Data

[60] Provisional application No. 60/030,093 Nov. 5, 1996.

[51] Int. Cl.[6] ..... B65D 81/22

[52] U.S. Cl. ..... 206/209; 206/812; 206/820; 206/823; 221/25

[58] Field of Search ..... 206/205, 209, 206/210, 484, 581, 812, 820, 823; 221/25, 26; 225/39, 53

[56] References Cited

U.S. PATENT DOCUMENTS

| | | | |
|---|---|---|---|
| 885,778 | 4/1908 | Neuberger | 206/484 |
| 2,813,623 | 11/1957 | Colovos | 206/484 |
| 3,190,499 | 6/1965 | Dow | 206/484 |
| 4,053,054 | 10/1977 | Lucas | 206/534 |
| 4,805,773 | 2/1989 | Sabongi | 206/489 |
| 5,072,831 | 12/1991 | Parrotta et al. | 206/232 |
| 5,160,022 | 11/1992 | Mennella | 206/581 |
| 5,232,371 | 8/1993 | Day-Cain | 434/428 |
| 5,320,217 | 6/1994 | Lenarz | 206/812 |

*Primary Examiner*—Jim Foster
*Attorney, Agent, or Firm*—Goldstein & Canino

[57] ABSTRACT

A compact material storage and dispensing unit for separately storing and dispensing small volumes of substances such as fragrances, creams and lotions. The unit comprises a circular plate which is divided into a plurality of storage cells, each storage cell substantially wedge shaped. The storage cells are disposed around a common center, and each storage cell is bounded by two radial lines which pass through the common center. Each storage cell further comprises a top ply, a bottom ply and impregnated packing sandwiched between the top and bottom ply. The impregnated packing is to be saturated with lotion, fragrance, ointment or any other desired substance. Perforations are formed into the radial lines which bound the storage cells, so that each storage cell may be easily separated from the adjacent storage cell and removed. Upon removing a particular storage cell from the circular plate, the top ply is separated from the bottom ply to expose the impregnated packing, and the substance contained within the impregnated packing is transferred to a desired location.

4 Claims, 2 Drawing Sheets

COMPACT MATERIAL STORAGE AND DISPENSING UNIT

This application relates to subject matter disclosed in Provisional application Ser. No. 60/030,093 filed in the United States Patent Office on Nov. 5, 1996.

BACKGROUND OF THE INVENTION

The invention relates to a compact material storage and dispensing unit. More particularly, the invention relates to a compact dispensing unit package for conveniently storing materials in a series of continuous yet separate, flat, isolated cells, and then allowing said materials to be easily dispensed therefrom.

The storage, transportation and dispensing of materials such as fragrances, lotions and creams has typically been accomplished in a variety of manners. Packaging methods such as bottles, jars and deformable packets are commonly employed to store and transport creams and lotions. Intricate and weighty glass containers are typically employed to store and transport fragrances such as perfumes and colognes. In addition, paper cards soaked in fragrances are often inserted into periodicals by fragrance manufacturers to provide free samples to the general public.

Quite often, an individual traveling on business or vacation believes it necessary to bring several of these bulky and heavy containers along on his or her journey. For instance, a traveler might wish to possess his or her favorite fragrance, sun tan lotion, sun burn cream, antiseptic, such as iodine or mercurochrome, nail polish remover, etc. In order to do so, the traveler needs to transport a large number of heavy and bulky containers even though typically only a small amount of each material, if any, will be utilized. For instance, an individual possessing an 8 ounce container of perfume is unlikely to use more than a few splashes of the fragrance, and hence has unnecessarily transported a much larger volume of fragrance then necessary. An individual possessing 16 ounces of mercurochrome, for example, would typically not need any at all unless an emergency had arisen, and even then an ounce or so of the material would suffice. Once again, the traveler would have unnecessarily transported a much larger volume of material then necessary. This problem would be avoided if there existed a compact dispensing unit package capable of storing various materials (such as perfumes, hand lotions, antiseptics, etc.) in separate, flat, isolated cells, and then allowing said materials to be easily dispensed therefrom.

In addition to business and vacation travelers, many individuals engaged in daily automobile commutes also wish to keep various fragrances, creams and lotions in their auto in case of emergency. For instance, it is quite common for individuals to keep a first aid kit containing numerous antiseptic creams and lotions in their vehicle. These kits are usually quite large and bulky, since they contain larger amounts of first-aid creams and lotions than would ever be needed by the motorist. Similarly, many motorists also commonly keep a bottle of perfume or cologne in the vehicle for social purposes. Once again, in the event that the scent from such perfume or cologne is needed, it is unlikely that more than a splash will be needed. Accordingly, the motorist finds him or herself transporting a greater number of containers of fragrances, creams and lotions than necessary. Again, this problem would be avoided if there existed a compact dispensing unit package capable of storing various materials in separate, flat, isolated cells, and then allowing said materials to be easily dispensed therefrom.

No significant attempts have been made in the field of packaging to provide individuals with alternatives to transporting large, numerous containers of fragrances, creams and lotions. While many materials are now offered in smaller "travel size" containers, these containers inevitably house a much greater volume of material than the individual could use during one trip or upon one emergency. Many fragrance manufacturers offer small, ampule-like containers of fragrance for travelers, but these containers still prove to be larger than necessary and incapable of being conveniently stored. As mentioned earlier, fragrance soaked papers are often inserted into periodicals by fragrance companies to provide samples to the public. This method of storing and transporting minuscule samples of fragrances has come under fire recently, due to the fact that the sample scents are not sealed within any defined or isolated cell and thus tend to escape and irritate those sensitive individuals who do not wish to sample the fragrance. While these units may be suitable for the particular purpose employed, or for general use, they would not be as suitable for the purposes of the present invention as disclosed hereafter.

SUMMARY OF THE INVENTION

It is an object of the invention to produce a material storage dispensing unit.

It is another object of the invention to produce a compact dispensing unit package for conveniently storing materials in a series of continuous yet separate, flat, isolated cells, and then allowing said materials to be easily dispensed therefrom.

It is a further object of the invention to produce a compact dispensing unit which permits small yet useful volumes of various fragrances, creams and lotions to be stored together, without said various fragrances coming into contact with each other.

It is a still further object of the invention to produce a compact dispensing unit package for conveniently storing materials in a series of continuous yet separate, flat, isolated cells, and then allowing said materials to be easily dispensed therefrom and applied with an applicator which conveniently comprises a part of said dispensing unit package.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
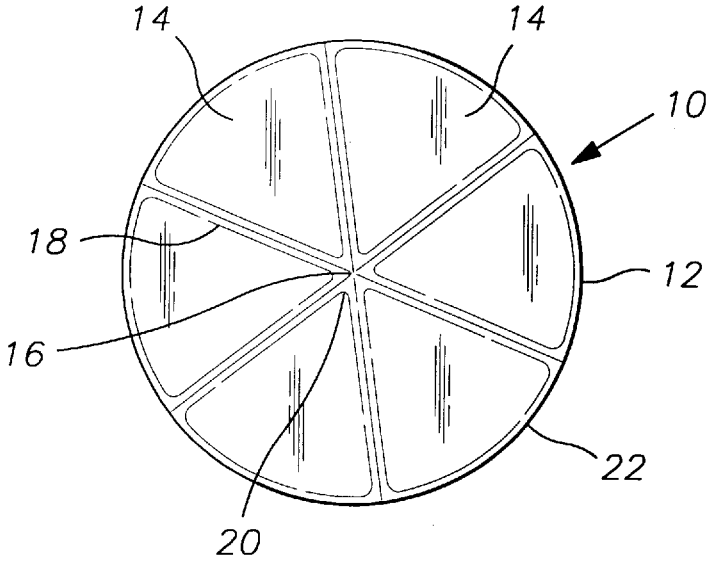
FIG. 1 is a top plan view of a compact material storage and dispensing unit, illustrating a plurality of storage cells located thereupon.

FIG. 1 illustrates a top plan view of a first embodiment of a compact material storage and dispensing unit 10. The compact material storage and dispensing unit 10 comprises a circular plate 12, which is divided into a plurality of storage cells 14, each storage cell 14 substantially wedge shaped. The plurality of storage cells 14 are disposed around a common center 16. Each storage cell 14 is bounded by two radial lines 18 which pass through the common center 16, thus forming an angled interior end 20 and an arcuate exterior end 22. The compact material storage and dispensing unit 10 may comprise any number of storage cells 14 whose angular distribution may or may not be uniform. As seen in FIG. 1, the embodiment contemplated thereat comprises six distinct storage cells 14, such that the angled interior ends form angles of sixty-degrees, while the arcuate exterior ends 22 each comprise one-sixth of a circle.

Figure 2:
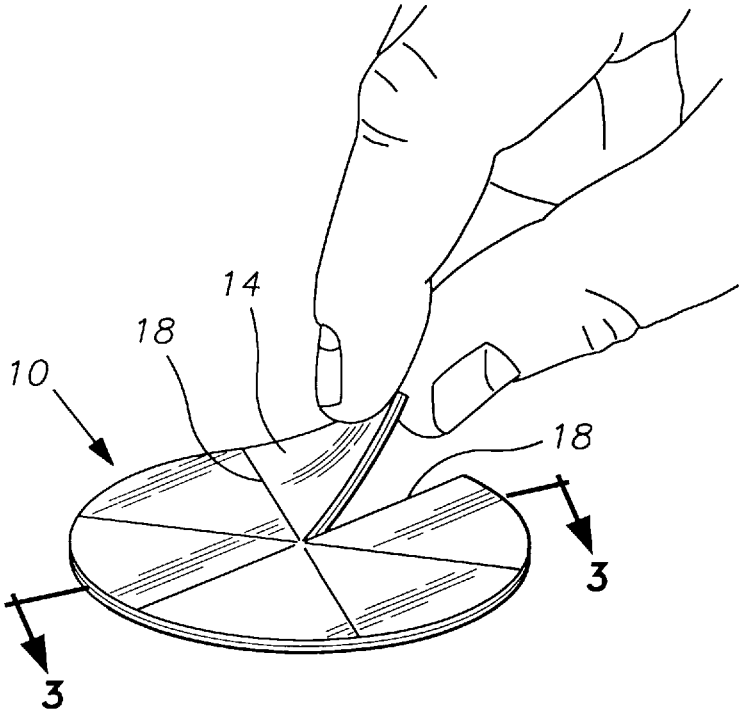
FIG. 2 is a diagrammatic perspective view showing one cell of the compact material storage dispensing unit being removed so that it may be opened to expose and dispense the material stored therein.
Figure 3:
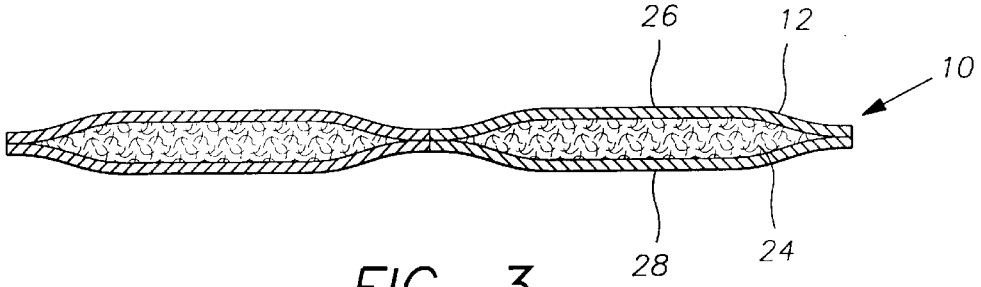
FIG. 3 is a cross sectional view taken along lines 3—3 of the compact material storage dispensing unit of FIG. 2.

FIG. 2 depicts one of the storage cells 14 of the compact material storage and dispensing unit 10 being removed. The radial lines 18 which bound each storage cell 14 are perforated, allowing each storage cell to be easily and cleanly separated and removed from adjacent storage cells 14. In the cross sectional view of the compact material storage and dispensing unit 10 represented by FIG. 3, it can be seen that the circular plate 12 comprises a top ply 26 and a bottom ply 28. Impregnated packing 24 is contained therebetween, and is saturated or impregnated with any desired material such as fragrance, lotion, first-aid cream, etc. Upon removing one of the storage cells 14 from the circular plate 12 along the perforated radial lines 18 as seen in FIG. 2, the top ply 26 is separated from the bottom ply 28 to expose the impregnated packing 24 contained therebetween.

Optimally, said impregnated packing 24 can comprise gauze, cotton or some similarly soft yet absorbent substance which is conducive to transferring the impregnated material to the skin of a user. According to this configuration, the plurality of storage cells 14 may contain various materials, allowing a user to possess only one compact material storage and dispensing unit 10 on a trip or voyage, yet still have small amounts of fragrances, creams and lotion which may be desired. For instance, one cell can contain packing 24 impregnated with nail polish remover, while an adjacent storage cell 14 contains packing 24 impregnated with nail polish, etc. Perfumes, hand lotions and first aid creams can all be contained in adjacent storage cells within one compact material storage and dispensing unit 10. Because of the small, flat size of the circular plate 12 which comprises the compact material storage and dispensing unit 10, it may be easily stored in a user's wallet or pocket, thus allowing the user to easily possess what would normally be contained in six bulky individual containers.

Figure 4:
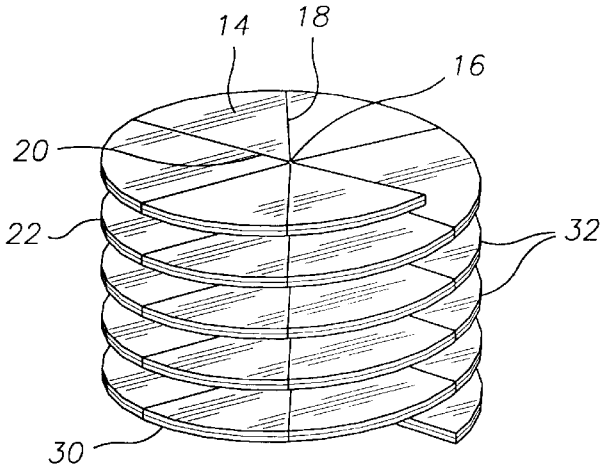
FIG. 4 is an alternate embodiment of the compact material storage dispensing unit, said embodiment comprising a helicoidal spiral configuration.

FIG. 4 depicts a second embodiment of the compact material storage and dispensing unit 10. In this second embodiment, a continuous helicoidal configuration 30 is substituted for the circular plate 12 of the first embodiment. In this embodiment, the plurality of storage cells 14 are again disposed around a common center 16, with each storage cell 14 bounded by two radial lines 18 which pass through the common center 16, forming the angled interior end 20 and an arcuate exterior end 22 similar to that of the first embodiment. As seen in FIG. 4, the embodiment contemplated thereat comprises a large number of distinct storage cells 14 having angled interior ends 20 forming angles of sixty-degrees, yielding a single, continuous spiraling strand of storage cells 14 from top to bottom. It should be understood, however, that the angled interior ends 20 can comprise angles of various sizes.

Due to this substitution, a large number of individual storage cells 14 can be employed. In the first embodiment where a single circular plate 12 is employed, increases in the number of storage cells 14 result in a corresponding decrease in the size of each storage cell 14 if the diameter of the circular plate 12 remains the same. A compact material storage and dispensing unit 10 of the second embodiment can have an unlimited number of storage cells 14 without increasing the diameter of the device and without decreasing the size of each storage cell 14, by simply adding a series of layers 32 of storage cells 14. When compressed together tightly, however, said layers 32 take up little more space than the single circular plate 12 of the first embodiment of the compact material storage and dispensing unit 10.

Figure 5:
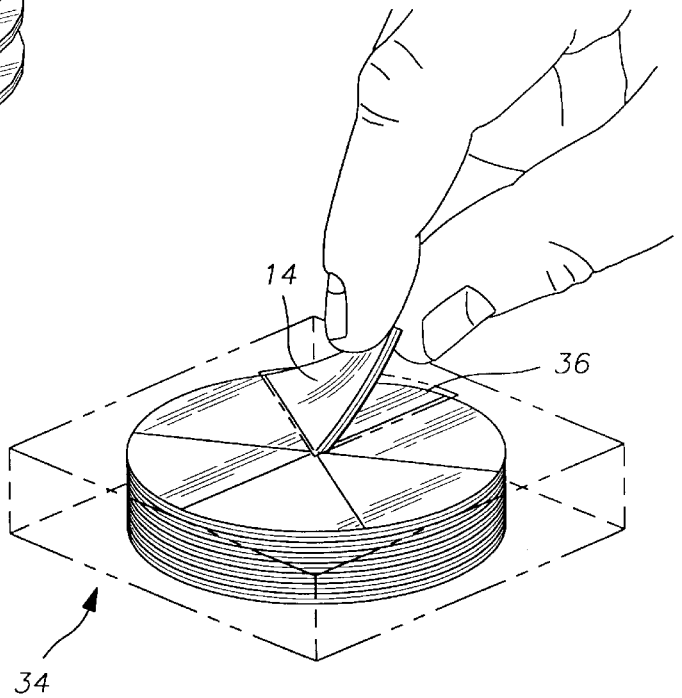
FIG. 5 is a diagrammatic perspective view showing one cell of the helicoidal spiral embodiment of the compact material storage dispensing unit being removed so that it may be opened to expose and dispense the material stored therein.

FIG. 5 depicts a dispensing unit housing 34 which houses the second embodiment of the compact material storage and dispensing unit 10. An opening 36 located upon the top of said dispensing unit housing 34 is sized approximately the same as the individual corresponding storage cell 14 located thereunder. Furthermore, the dispensing unit housing 34, which is square in shape, is sized just slightly larger than the diameter of the compact material storage and dispensing unit 10, so that said dispensing unit 10 is contained snugly within said dispensing unit housing 34, but is permitted to rotate therein. Accordingly, consecutive storage cells 14 can be pulled through said opening 36, causing the compact material storage and dispensing unit 10 contained therein to rotate and unravel in response so that the next consecutive storage cell 14 is always available to be removed. Once the storage cell 14 is removed, the impregnated packing 24 may be extracted from between the top ply 26 and bottom ply 28 by peeling said plies apart.

What is claimed is:

1. A compact material storage and dispensing unit for separately storing and dispensing small volumes of substances such as fragrances, creams and lotions, comprising:

a) a circular plate which is divided into a plurality of storage cells, each storage cell substantially wedge shaped, the storage cells disposed around a common center and each storage cell bounded by two radial lines which pass through the common center whereby an angled interior end and opposite arcuate exterior end are formed, and each storage cell further comprises a top ply, a bottom ply and impregnated packing sandwiched therebetween, said impregnated packing saturated with a desired substance; and b) perforations formed into the radial lines which bound the storage cells, so that each storage cell may be easily separated from the adjacent storage cell and removed therefrom, whereby upon removing a particular storage cell from the circular plate, the top ply is separated from the bottom ply to expose the impregnated packing, and the substance contained within the impregnated packing transferred to a desired location such as a user's skin.

2. The compact material storage and dispensing unit of claim 1, wherein the impregnated packing consists of cotton.

3. The compact material storage and dispensing unit of claim 1, wherein the circular plate further comprises a continuous helicoidal spiral of storage cells, resulting in a large number of isolated storage cells being contained within numerous layers of the circular plate.

4. The compact material storage and dispensing unit of claim 3, further comprising a dispensing unit housing having a top and an opening located at said top, and an interior for accepting and retaining the compact material storage and dispensing unit, the interior configured slightly larger than the diameter of the compact material storage and dispensing unit so that said unit is retained snugly therein yet permitted to rotate, wherein consecutive storage cells can be pulled through the opening, causing the compact material storage and dispensing unit to rotate and unravel in response so that the next consecutive storage cell is always available to be removed, and the impregnated packing extracted from between the top ply and bottom ply by peeling said plies apart.

* * * * *